US010188895B1

(12) United States Patent
Wallace

(10) Patent No.: US 10,188,895 B1
(45) Date of Patent: Jan. 29, 2019

(54) WEIGHT EXERCISER WITH FLEXIBLE PERIMETER GRIP BAND

(71) Applicant: Matthew Stephen Wallace, Atlanta, GA (US)

(72) Inventor: Matthew Stephen Wallace, Atlanta, GA (US)

( * ) Notice: Subject to any disclaimer, the term of this patent is extended or adjusted under 35 U.S.C. 154(b) by 50 days.

(21) Appl. No.: 15/243,827

(22) Filed: Aug. 22, 2016

Related U.S. Application Data

(60) Provisional application No. 62/283,129, filed on Aug. 20, 2015.

(51) Int. Cl.

| | |
|---|---|
| ***A63B 21/04*** | (2006.01) |
| ***A63B 21/05*** | (2006.01) |
| ***A63B 21/072*** | (2006.01) |
| ***A63B 21/055*** | (2006.01) |
| ***A63B 21/06*** | (2006.01) |
| ***A63B 23/02*** | (2006.01) |
| ***A63B 23/035*** | (2006.01) |
| ***A63B 23/16*** | (2006.01) |

(52) U.S. Cl.
CPC ..... *A63B 21/0726* (2013.01); *A63B 21/0552* (2013.01); *A63B 21/0607* (2013.01); *A63B 23/0233* (2013.01); *A63B 23/03508* (2013.01); *A63B 23/16* (2013.01)

(58) Field of Classification Search
CPC ..... A63B 21/0726; A63B 21/0728; A63B 21/047; A63B 21/0414; A63B 2051/143; A63B 23/16; A63B 21/072–21/075
See application file for complete search history.

(56) References Cited

U.S. PATENT DOCUMENTS

| | | | | | |
|---|---|---|---|---|---|
| 850,964 | A * | 4/1907 | Monier | A63B 21/075 | 482/108 |
| 965,284 | A | 7/1910 | Dossetter | | |
| 10,262,215 | | 5/1912 | Korth | | |
| 1,113,791 | A | 10/1914 | Latella | | |
| 1,119,169 | A * | 12/1914 | Kepple | A63B 21/026 | 482/108 |
| 1,138,459 | A * | 5/1915 | Day | A63B 21/0726 | 482/108 |
| 1,229,658 | A | 6/1917 | Sandow | | |
| 2,263,135 | A | 11/1941 | Johnson | | |
| 2,814,491 | A | 11/1957 | Proctor | | |
| 3,268,225 | A * | 8/1966 | Kolbel | A63B 21/00043 | 482/126 |
| 3,950,803 | A * | 4/1976 | Reynolds | B63B 17/04 | 105/380 |
| 4,021,040 | A | 5/1977 | Inoue | | |
| 4,199,140 | A * | 4/1980 | Ferretti | A63B 21/0602 | 222/210 |
| 4,290,599 | A * | 9/1981 | Berger | A63B 21/00072 | 482/112 |

(Continued)

*Primary Examiner* — Nyca T Nguyen
(74) *Attorney, Agent, or Firm* — Valerie M. Davis; Alexander Legal LLC

(57) ABSTRACT

The dumbbell exercise device may include a bar, end-weights at opposite ends of the bar, housings enclosing the end-weights, and a resistance band. The resistance band may be engaged by the first and second housings and extend between the first and second end-weights at or near a perimeter of the end-weights. This and other embodiments provide enhanced lifting effects and engage muscle groups to improve grip strength.

16 Claims, 10 Drawing Sheets

(56) References Cited

U.S. PATENT DOCUMENTS

| | | | | |
|---|---|---|---|---|
| 4,333,645 | A * | 6/1982 | Wu | A63B 21/00043 482/112 |
| 4,681,315 | A | 7/1987 | Yang | |
| 5,087,032 | A * | 2/1992 | Gresh | A63B 21/0004 482/50 |
| 5,879,274 | A * | 3/1999 | Mattox | A63B 21/0605 482/107 |
| 8,025,615 | B1 * | 9/2011 | Sargent | A63B 21/0552 482/139 |
| 2003/0114276 | A1 * | 6/2003 | Schiff | A63B 21/0728 482/93 |
| 2004/0152571 | A1 * | 8/2004 | Udwin | A63B 21/00043 482/128 |
| 2008/0287272 | A1 * | 11/2008 | Luckadue | A63B 21/027 482/107 |

* cited by examiner

WEIGHT EXERCISER WITH FLEXIBLE PERIMETER GRIP BAND

RELATED APPLICATION

This application claims the benefit of U.S. Provisional Patent Application No. 62/283,129, filed Aug. 20, 2015, and titled "WEIGHT EXERCISER WITH FLEXIBLE PERIMETER GRIP BAND", the entire teaching of which is incorporated herein by reference.

BACKGROUND

1. Field

Embodiments of the present invention relate generally to the field of exercise equipment and particularly to an improved dumbbell exercise device.

2. Description of the Related Art

Conventional dumbbells typically include a short bar between two end-weights. Conventional dumbbells allow a user to build upper body muscle through a variety of exercises. However, these dumbbells offer only limited exercise focused almost entirely on the upper arms, making the exercise effects slow, tedious, and limited. Furthermore, typical dumbbell exercises with conventional dumbbells may not help a user in developing the muscles of the forearms, shoulders, and upper back, and their grip strength, that is, the muscles of a user's hand. Grip strength, for example, is critical for some athletic events, such as obstacle course competitions (e.g., American Ninja Warrior®), rock climbing, and martial arts.

There have been attempts to add grip strength development functionality to dumbbells. For example, U.S. Pat. No. 965,284 titled "SPRING GRIP ATTACHMENT FOR DUMB BELLS" discloses a dumbbell having a spring grip attachment. A rigid grip member on two spindles having springs is attached to a dumbbell.

U.S. Pat. No. 1,026,215 titled "GRIP DUMB BELL" discloses a design combining a dumbbell with a grip exerciser. A rigid grip exerciser handle is attached to one end of a dumbbell via a spring.

U.S. Pat. No. 1,113,791 titled "CONVERTIBLE DUMBBELL" discloses a dumbbell that is convertible in that the dumbbell can be converted from an elastic or yielding dumbbell (one that compresses) to a solid dumbbell.

U.S. Pat. No. 1,229,658 titled "DUMB BELL" discloses a design having a handle formed from two spring-controlled longitudinal members adapted to yield or be compressed and to provide uniformly distributed resistance to the user's grasp.

U.S. Pat. No. 2,263,135 titled "EXERCISER AND STRENGTH TESTER" discloses a dumbbell including an arch portion and movable carriage for developing muscles of the hand and forearm.

U.S. Pat. No. 2,814,491 titled "EXERCISING DEVICE" discloses a dumbbell including a pair of spaced bars to be grasped in one hand in a manner such that closing of the hands shifts the bars towards each other while lifting the dumbbell.

U.S. Pat. No. 4,021,040 titled "BARBELL WITH REMOVABLE WEIGHTS AND A SPRING TYPE GRIPPING DEVICE" discloses a dumbbell grip promoting member supported by a spring and extending in a triangular fashion.

U.S. Pat. No. 4,681,315 titled "DUMBBELL WITH DOUBLE COVER HAND PROTECTOR AND GRASPING TRAINING FUNCTION" discloses a dumbbell with two opposing and rigid bas positioned near to one another and attached at a fulcrum to the bar of the dumbbell.

U.S. Pat. No. 5,087,032 titled "GRIP EXERCISER USED WITH WEIGHT ASSEMBLY" discloses different embodiments of a grip exerciser used with a weight assembly. In one embodiment, a grip exercise device is insertable into a dumbbell bar. In other embodiments, an inflatable chamber or compressible material may be positioned over the bar of a dumbbell. In another embodiment, a double layer band stretching within a space smaller than the space from one end-weight to another is provided. Finally, in another embodiment, a double layer band stretching from U-shaped clips inserted into the end-weights is provided.

However, these previous attempts to add grip strength development functionality to dumbbells have limitations recognized by the present inventor and described more herein. Accordingly, an improved dumbbell exercise device is desirable.

BRIEF SUMMARY

It is an aspect of the present invention to provide an improved dumbbell exercise device.

According to an aspect of the present invention, a dumbbell exercise device may be provided. The dumbbell exercise device may include a bar, first and second end-weights at opposite ends of the bar, first and second housings enclosing the first and second end-weights, respectively, and a resistance band. The resistance band may be engaged by the first and second housings and extend between the first and second end-weights at or near a perimeter of the first and second end-weights.

According to another aspect of the present invention, a dumbbell exercise device may be provided. The dumbbell exercise device may include a bar, first and second hexagonal end-weights fixedly attached or integral with opposite ends of the bar, and a single rubber resistance band. The single rubber resistance band may extend between the first and second hexagonal end-weights at or near a perimeter of the first and second hexagonal end-weights at two positions opposite to one another.

According to another aspect of the present invention, a dumbbell exercise device may be provided. The dumbbell exercise device may include a first housing configured to receive a first end-weight of a dumbbell, a second housing configured to receive a second end-weight of the dumbbell, and a resistance band. The resistance band may be configured to extend parallel or substantially parallel to a bar of the dumbbell and extend between the first and second housings at or near a perimeter of the first and second housings.

The foregoing and other aspects will become apparent from the following detailed description when considered in conjunction with the accompanying drawing figures.

DESCRIPTION

Figure 1:
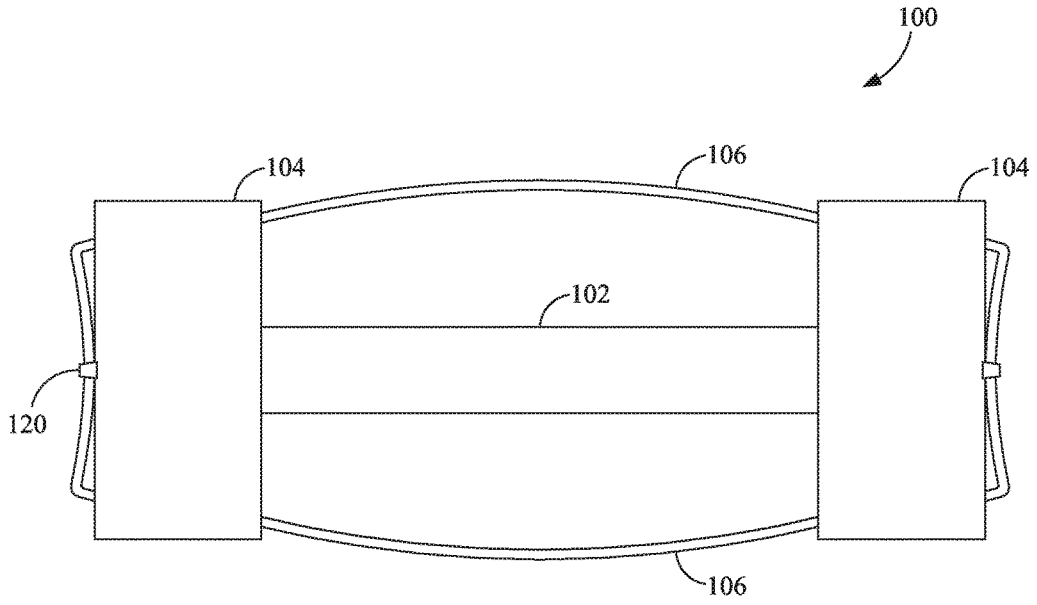
FIG. 1 is a top view of dumbbell exercise device according to an exemplary embodiment of the present invention.

Reference will now be made in detail to embodiments of the present invention, examples of which are illustrated in the accompanying figures, wherein like reference numerals refer to the like elements throughout. The embodiments are described below to explain the present invention by referring to the figures.

As used in the description of this application, the terms "a", "an" and "the" may refer to one or more than one of an element (e.g., item or act). For example, references to "a grip band" may refer to one or more than one grip band. Similarly, a particular quantity of an element may be described or shown while the actual quantity of the element may differ. For example, although a bar may be shown or described, more than one bar may be provided. The terms "and" and "or" may be used in the conjunctive or disjunctive sense and will generally be understood to be equivalent to "and/or". Elements from an embodiment may be combined with elements of another embodiment. Elements described as separate elements may be combined into a single element. Similarly, an element described as single element may be split into two or more elements. No element used in the description of this application should be construed as critical or essential to the invention unless explicitly described as such. Further, when an element is described as "connected," "coupled," or otherwise linked to another element, it may be directly linked to the other element, or intervening elements may be present.

As noted above, previous attempts to add grip strength development functionality to dumbbells present problems recognized by the present inventor. For example, devices using spindles and/or springs to attach rigid grip members and handles have several pinch points that may injure a user. Spring loaded members may create mechanical and manufacturing complexities. Further, moveable pieces, often metal, are exposed in such designs causing additional hazards. Similarly, where a wedged mechanism is provided over and surrounds a cover of a dumbbell, a pinching hazard exists. Similarly, multi-layer band designs similarly may cause pinching in operation.

Where a traditional handgrip or detachable handgrip is attached to one side of a dumbbell, the handgrip does not extend in an even fashion across the length of the dumbbell. Accordingly, a user's hand may not grip at a uniform height or extension with their hand, which limits engagement of some of the user's fingers. Use of the handgrip does not allow full hand extension, and the user can only exercise the fingers (and sometimes only some of the fingers) or the thumb, but not both at the same time. Further, this traditional design may not fully enhance the motion of muscles exercised as part of a lifting process, and may not engage all of the muscles engaged by the present embodiments.

Previous attempts to add grip strength development functionality to a dumbbell fall short in enhancing dumbbell exercises.

An improved dumbbell exercise device has been developed by the present inventor. In accordance with an exemplary embodiment of the present invention, a dumbbell exercise device is provided. The dumbbell exercise device may include a bar and end-weights at opposite ends of the bar. A resistance band extends between the end-weights parallel to the bar. The resistance band is displaced from the bar of the dumbbell and offers resistance when depressed by a user.

The present embodiments eliminate the need for springs and poles, and reduce or eliminate pinch points. The present embodiments use a flexible band. The flexible resistance band may extend along the length of the dumbbell exercise device on opposite sides of a bar of the dumbbell exercise device. Such embodiments double a range of squeezing motion, allow for several different exercise functions, and increase effectiveness of the device in terms of finger, hand, and grip development, involvement of additional muscle groups, as well as in terms of weightlifting strength development. The present embodiments also allow traditional use of the dumbbell in addition to the enhanced exercises. In some embodiments, housings enclosing the end-weights may be provided and one or more resistance bands may be engaged by the first and second housing thereby extending between the first and second end-weights. In some of these embodiments, the housings may be larger in diameter than the end-weights facilitating a design where the resistance band(s) are further away from the bar thereby increasing the range of motion of the user's hands.

Turing to the figures, FIG. 1 is a top view of a dumbbell exercise device 100 according to an exemplary embodiment of the present invention. The dumbbell exercise device 100 may include a bar 102, end-weights 104 at opposite ends of the bar 102, and at least one resistance band 106.

The dumbbell exercise device 100 may be a fixed-weight dumbbell including end-weights 104 fixedly attached to or integral with the bar 102. The dumbbell exercise device 100 may be configured in a variety of weights (e.g., 5 lbs, 10 lbs, 15 lbs, 20 lbs, 25 lbs, etc.). In alternative design, an adjustable weight dumbbell may be provided including end-weights removable from the bar. The removable end-weights may be of appropriate and variable weights.

The bar 102 may be a solid bar. The bar 102 may be straight. The bar 102 may be formed of metal such as iron or steel. The bar 102 may include a knurled or scored outer surface forming a handle for the user to grip. Additionally or alternatively, the bar 102 may include a handle cover, such as rubber or vinyl forming the handle for the user to grip. Alternative embodiments may include a hollow bar, a bar countered to a user's hand, and/or a bar formed of alternative materials such as plastic. In a removable-weight embodiment, the bar may include sleeves and/or collars configured to secure the end-weights.

The end-weights 104 may be solid. The end-weights 104 may be circular. The end-weights may be formed of metal such as iron or steel. The end-weights 104 may be fixedly attached to or integral with the bar 102. The end-weights 104 may constitute a majority of the overall weight of the dumbbell exercise device 100. Alternative embodiments may include hollow end-weights that may be filled with fluid and/or granular materials such as sand, alternatively shaped end-weights (e.g., hexagon, square, etc.,), end-weights formed of alternative materials such as plastic, and/or may be covered by coatings such as a rubber or neoprene. In a removable-weight embodiment, the end-weights may each include a hole configured to receive the bar.

The resistance band 106 may extend between the end-weights 104 at or near a perimeter of the end-weights. By "at or near a perimeter of the end-weights", an interpretation is intended that may include a position outside of the bar 102 within the perimeter of the end-weights 104, at the perimeter of the end-weights, or beyond the perimeter of the end-weights. The resistance band may extend parallel or substantially parallel to the bar (i.e., horizontally along the bar). By "parallel or substantially parallel to the bar", an interpretation is intended that may include exactly parallel to the bar, as well along a line or arch that is not exactly parallel, but contoured or arched from one end-weight or housing to another end-weight or housing. Alternatively and/or additionally, one or more resistance band or a portion thereof may be non-parallel to the bar. For example, in one embodiment, multiple interconnected bands may be provided in variety of configurations thereby defining different geometric designs. The interconnected bands may be different colors depending on the weight of the device, and/or the interconnected bands may be multicolored.

In the embodiment of FIG. 1, the resistance band 106 may be formed of metal. The resistance band 106 may be covered by a material such as vinyl, plastic, rubber, or neoprene. The resistance band 106 shown in FIG. 1 may be a continuous band having no ends. The resistance band 106 may extend through a first end-weight at a first position thereof, then substantially parallel to the bar, then through a second end-weight at a first position thereof, then along an outer side of the second end-weight 104. The resistance band 106 may then extend back through the second end-weight at a second position thereof, then substantially parallel to the bar, then through the first end weight at a second position thereof, then along an outside of the first end-weight, and then back through the first end-weight at the first position thereof. The resistance band 106 may be secured along the outer side of the end-weights 104 by an attachment plate 120. The resistance band may be flexible, but offer resistance when the user grasps either or both sides of the band. Alternative embodiments (such as the embodiment of FIGS. 4-6) may include a resistance band formed of alternative flexible materials, such as rubber.

Figure 2:
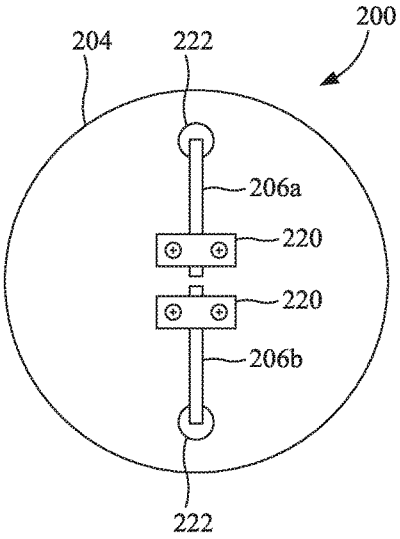
FIG. 2 is a side view of a dumbbell exercise device according to another exemplary embodiment of the present invention.

FIG. 2 is a side view of a dumbbell exercise device 200 according to another exemplary embodiment of the present invention. In describing FIG. 2 and the remaining figures, a discussion of features similar to those already described is omitted in the interest of brevity. In the embodiment 200 of FIG. 2, two separate resistance bands 206*a*, 206*b* may be secured to the end-weights 204 by one or more attachment plates 220. The attachment plates 220 may be secured to the end-weights 204 by one or more screws, pins, bolts, or other fasteners. A first resistance band 206*a* may be secured to a first of the end-weights 204, then extend through a hole 222 in the first end-weight at a first position thereof, then substantially parallel to the bar, then through a hole in a second of the end-weights 204 at a first position thereof, then to an attachment plate, which may be secured to the second end-weight. A second resistance band 206*b* may be secured to a first of the end-weights 204, then extend through a hole 222 in the first end-weight at a second position thereof and opposite to the first position, then substantially parallel to the bar, then through a hole in the second end-weight 204 at a second position thereof opposite the to the first position, then to an attachment plate, which may be secured to the second end-weight. Alternatively and/or additionally, the resistance bands may be secured by plates welded, soldered, glued or otherwise affixed to the end-weights. In another alternative embodiment, notches may be provided at opposite edges of the perimeter of the end-weights instead of holes.

In another alternative embodiment, one resistance band having two ends may be provided. The resistance band may be secured to a first of the end-weights by one or more attachment plates, then extend through a hole in the first end-weight at a first position thereof, then substantially parallel to the bar, then through a hole in a second of the end-weights at a first position thereof. The resistance band may extend along or near the second end-weight, then extend through a hole in the second end-weight at a second position thereof and opposite to the first position, then substantially parallel to the bar, then through a hole in the first end-weight at a second position thereof opposite the to the first position, then to the same attachment plate or a different attachment plate.

Figure 3:
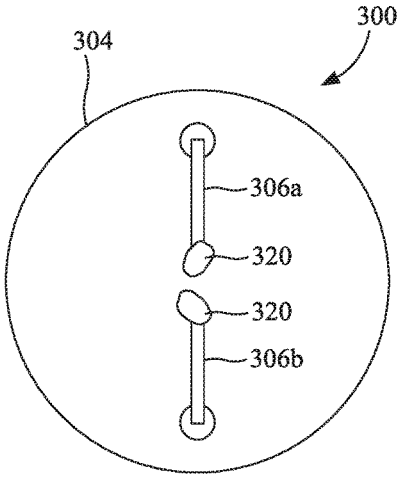
FIG. 3 is a side view of a dumbbell exercise device according to another exemplary embodiment of the present invention.

In the embodiment 300 of FIG. 3, two separate resistance bands 306*a*, 306*b* may be secured to the end-weights 304 by soldering 320. Alternatively, the resistance bands 306*a*, 306*b* may be affixed to the end-weights 304 by welding, melting, gluing or other fasteners.

Figure 4:
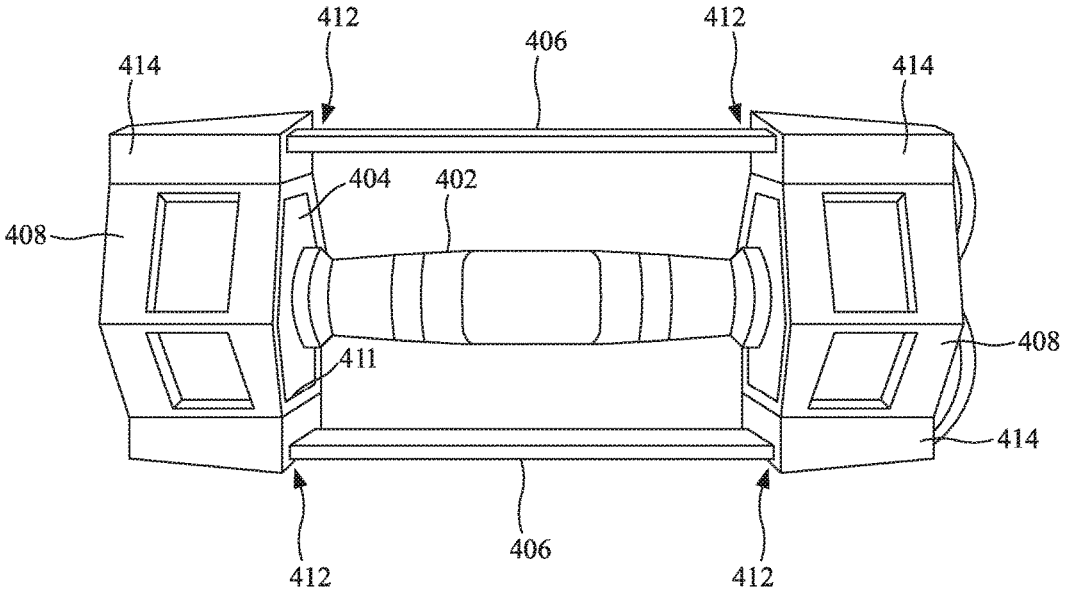
FIG. 4 is a front view of a dumbbell exercise device according to another exemplary embodiment of the present invention.
Figure 5:
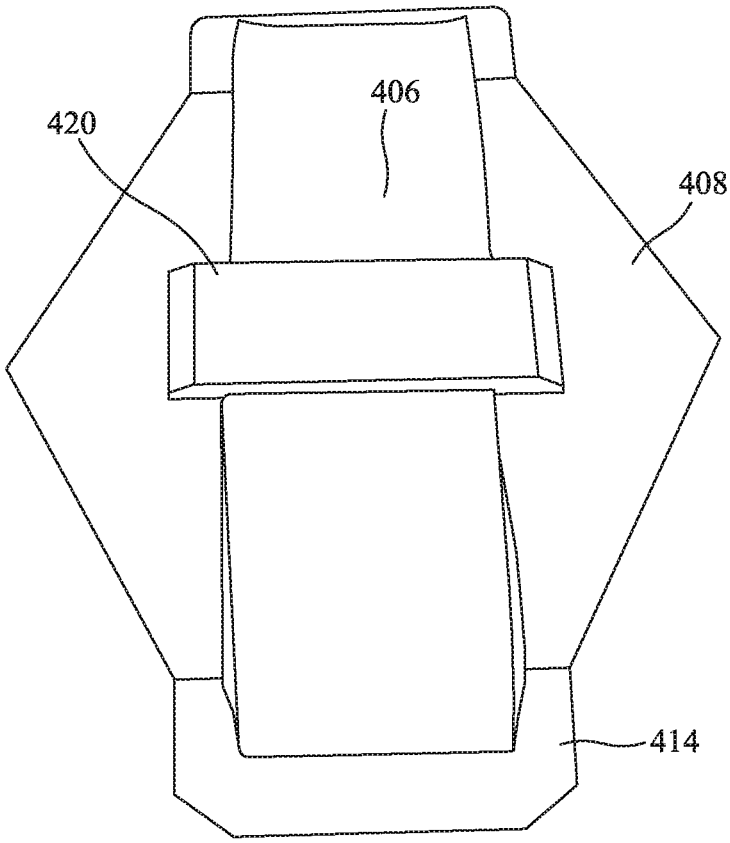
FIG. 5 is a side view of the dumbbell exercise device of FIG. 4.
Figure 6:
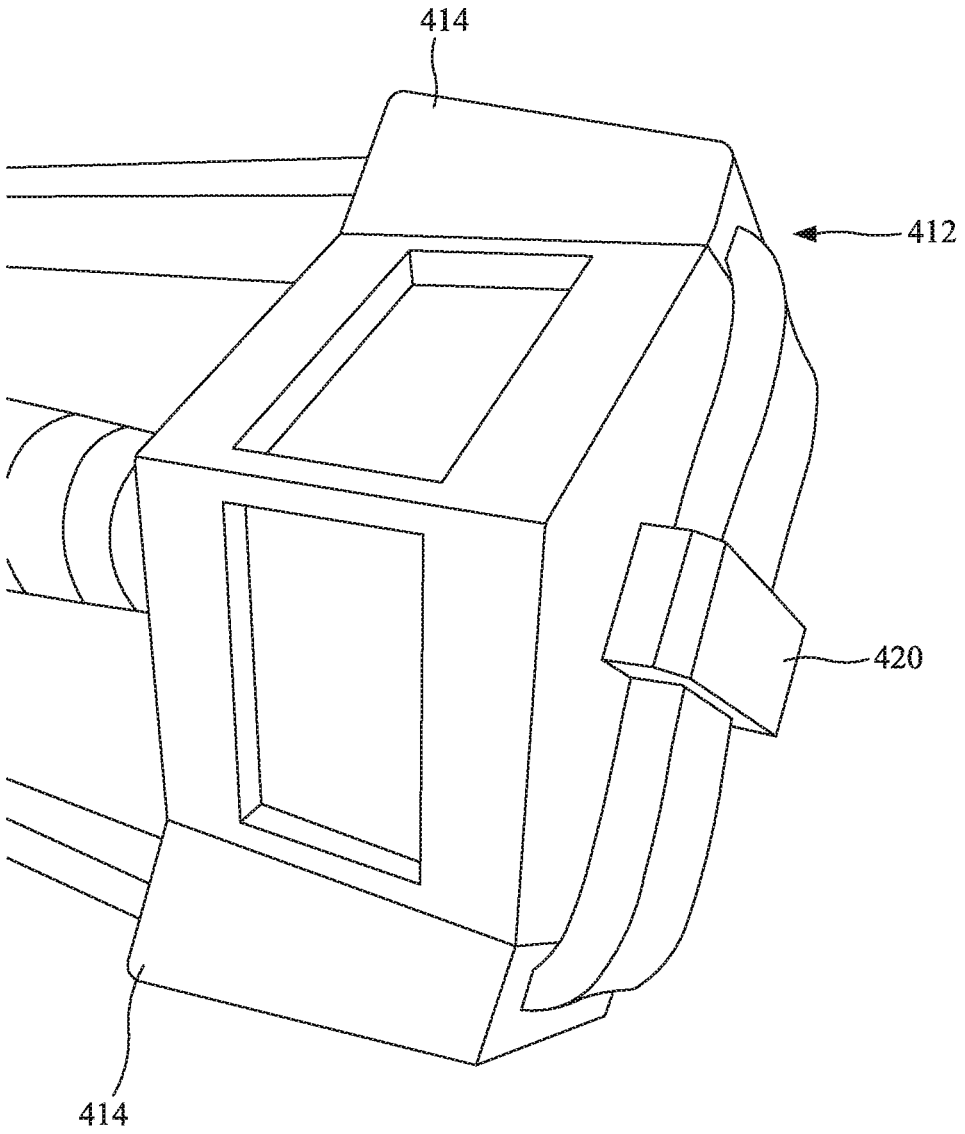
FIG. 6 is a perspective view of the dumbbell exercise device of FIG. 4.

FIG. 4 is a front view of a dumbbell exercise device according to another exemplary embodiment of the present invention. FIG. 5 is a side view of the dumbbell exercise device of FIG. 4. FIG. 6 is a perspective view of the dumbbell exercise device of FIG. 4. The dumbbell exercise device 400 may include a bar 402, end-weights 404 at opposite ends of the bar 402, and a resistance band 406. The dumbbell exercise device 400 may further include housings 408 enclosing the end-weights 404. The dumbbell exercise device 400 may be configured in a variety of weights. In an alternative embodiment, the housings may partially enclose the end-weights.

The dumbbell exercise device 400 may be a fixed-weight dumbbell where the end-weights 404 are fixedly attached to or integral with the bar 402. The dumbbell exercise device 400 may include housings 408 fixedly attached to the end-weights 404. The housings 408 may be attached to the end-weights 404 by glue, screws, bolts, clips, grooves, or other fasteners. Additionally, or alternatively, the housings 408 may be attached to the end-weights 404 and held in place by the tension of the resistance band 406 between and/or against the housings 408. In such an embodiment, the housings 408 and the resistance band 406 may be removed from bar 402 and end-weights 404. In another embodiment, the housings may be molded with clips to fasten the housings to the end-weights. In another embodiment described herein, the housings may each be formed of multiple pieces that may be attached to each other around or over an end-weight by blue, screws, bolts, clips grooves, or other fasteners. In yet another embodiment, the housings may be secured to the end-weights and/or each other by welding or soldering if formed of appropriate materials such as metal.

The bar 402 may be a solid bar. The bar 402 may be slightly contoured. The bar 402 may be formed of steel. The outer surface of the bar 402 may include knurled or scored sections for the user to grip.

The end-weights 404 may be solid. The end-weights 404 may be hexagonal, each including an inner surface, an outer surface, and six side surfaces. The end-weights may be formed of iron and covered by a material such as plastic (e.g., polyvinyl chloride) to, for example, act as a bumper if dropped. The end-weights 404 may be fixedly attached to the bar. The end-weights 404 may constitute a majority of the overall weight of the dumbbell exercise device 400. Alternative embodiments may include end-weights in other shapes such as square end-weights, circular end-weights, and partially circular end-weights. In yet another embodiment, the material covering the end-weight 406 and the housings 408 (discussed below) may be integral to one another (e.g., a rubber or PVC housing that serves, for example, as a bumper if dropped). In yet another embodiment, the material covering the end-weight 406 may further cover the bar 402.

The housings 408 may be hexagonal. The housings 408 may each include an outer wall and six sidewalls thereby defining a hexagonal cavity 410 configured to receive an end-weight 404. One or more inner surfaces 411 of the sidewalls of each housing may engage the side surfaces of a corresponding end-weight. The inner surface of the outer wall of each housing may engage the outer surface of a corresponding end-weight. At least by virtue of the surface to surface engagement (i.e. abutment), the housings may be prevented from rotational movement around the end-weights. In an embodiment where each housing is formed from multiple pieces, the surface to surface engagement may prevent movement of one piece relative to another. One or more of the sidewalls may include a hole through which the corresponding side surfaces of the end-weight may be visible. Alternative embodiments may include housings in other shapes such as square housings, circular housings, and partially circular housings. Alternative embodiments may include cavities in other shapes such as square cavities, circular cavities, and particularly circular cavities, that may or may not match the shape of the housings.

The housings 408 may each include two slots 412 extending through corresponding slot members 414. The slots may be rectangular. The slot members 414 may be attached to and/or abut two opposite sidewalls. The housing 408 may be formed of appropriate plastics. Alternatively, the slot members may be integral with the housings. In yet another alternative embodiment, the slots 412 may extend directly through the housings without slot members. In yet other alternative embodiments, the slots may be alternative shapes such as rectangular with semicircular sides. In yet another embodiment, slots may be omitted altogether and one or more resistance bands may extend from one housing to another housing.

Turning back to FIG. 4, the resistance band 406 may extend between the end-weights 404 at or near a perimeter of the end-weights 404. In the embodiment of FIGS. 4-6, the resistance band 406 may be formed of rubber. The resistance band 406 may be a continuous band having no ends. The resistance band 406 may extend through a first slot 412 of a first housing 408, then substantially parallel to the bar, then through a first slot 412 of a second housing 408. The resistance band 406 may then extend along an outer surface of the outer wall of the second housing, then back through a second slot 412 of the second housing 408, then substantially parallel to the bar, then through a second slot 412 of the first housing. The resistance band may then extend along an outer surface of the outer plate of the first housing and then back again through the first slot 412 of the first housing. Accordingly, the resistance band may be engaged by the first and second housing thereby extending between the first and second end-weights. Some or all of each housing 408 may extend beyond a perimeter of the end-weight (such as in this case, at least the slot members 414). Accordingly, the resistance band may extend beyond a perimeter of the end-weights 404. The resistance band may pass through one or more tensioners so that the tension of the resistance band may be adjusted. For example, a cinch mechanism and/or a ratchet mechanism may be provided on one or both housings. As another example, belt holes with a corresponding buckle may be provided. In an alternative embodiment where the resistance band is one band having two ends, one or both ends of the resistance band may be attached to the tensioner(s).

Figure 7:
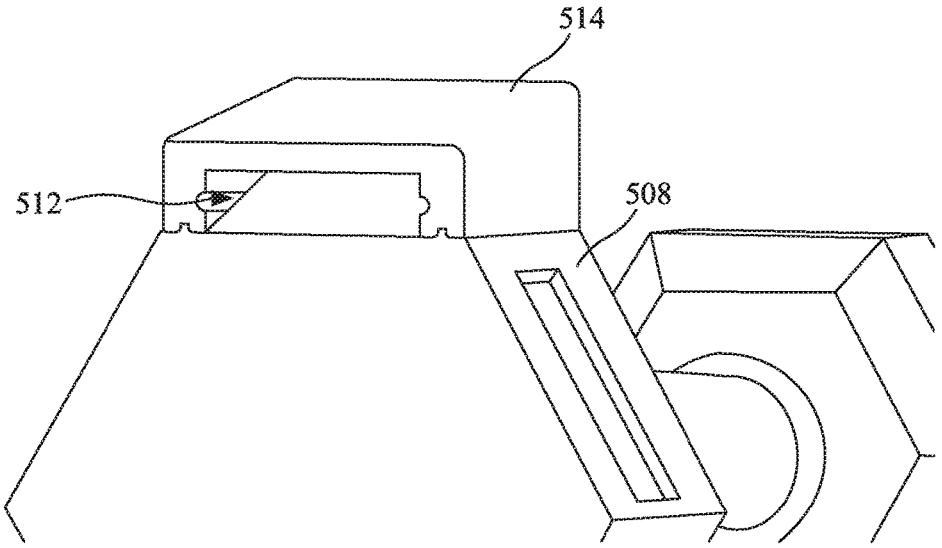
FIG. 7 is a perspective view of a housing of a dumbbell exercise device according to another exemplary embodiment of the present invention.
Figure 8:
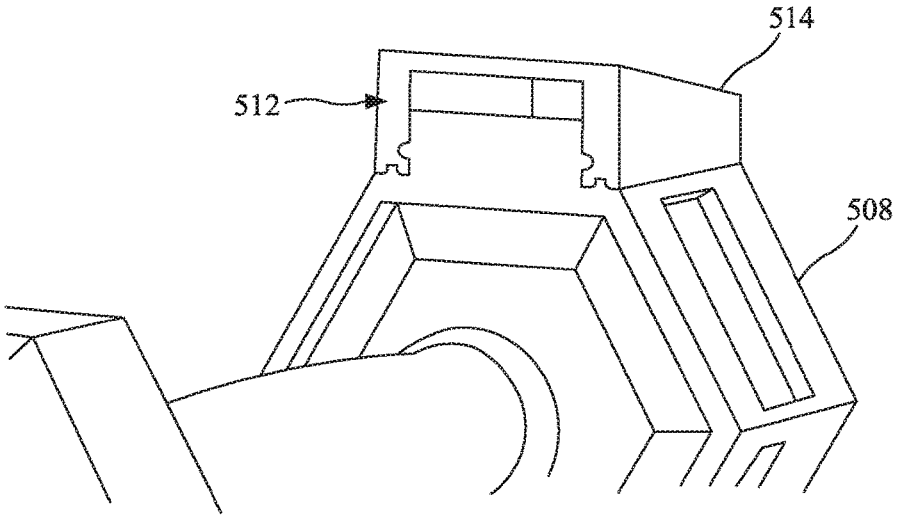
FIG. 8 is a perspective view of the housing of FIG. 7.

FIG. 7 is a perspective view of a housing of a dumbbell exercise device according to another exemplary embodiment of the present invention. FIG. 8 is a perspective view of the housing of FIG. 7. In the embodiment of FIGS. 7 and 8, a housing 508 surrounds an end-weight. The housing 508 may be hexagonal. The housing 508 may include an outer wall and six sidewalls thereby defining a hexagonal cavity. Alternatively or additionally, the housing may include a portion defining an inner lip or inner wall to secure the housing to the end-weight. By virtue of the surface to surface engagement of the sidewalls of the housing 508, the outer-wall the inner lip or inner wall, the housing 508 may be prevented from rotational movement around the end-weights and movement relative to the end-weight. The housing 508 may include two or more slots 512 extending through corresponding slot members 514. The slot members 514 may include grooves for slidably attaching the slot members 514 to the housings 508. The slot members 514 may alternatively snap to the housings 508.

Figure 9:
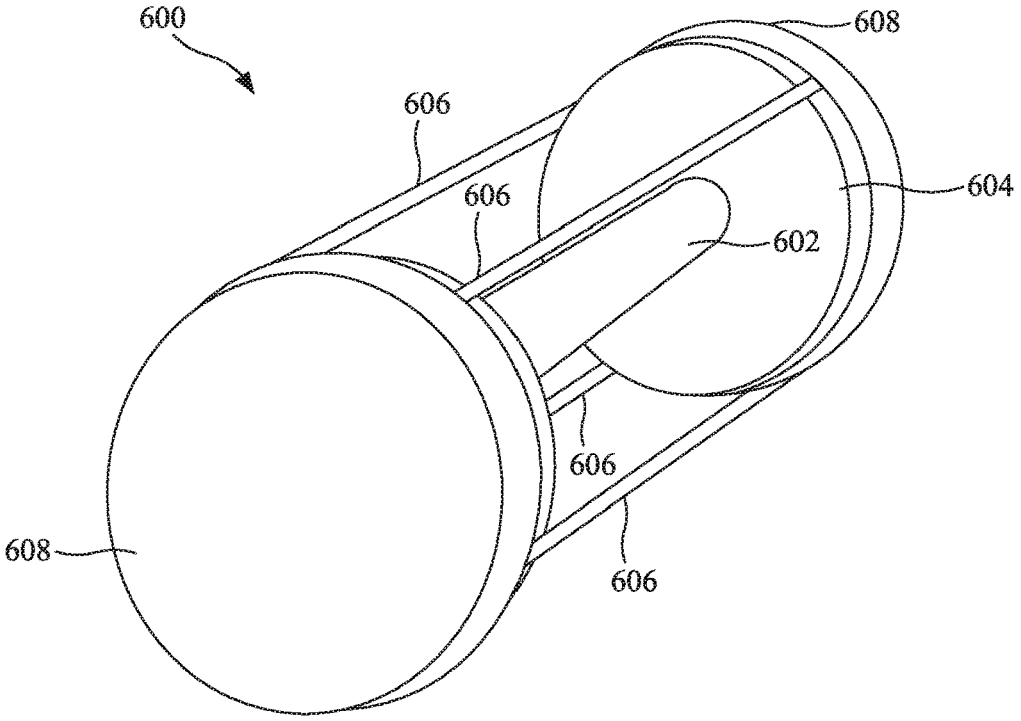
FIG. 9 is a perspective view of a dumbbell exercise device according to another exemplary embodiment of the present invention.

FIG. 9 is a perspective view of a dumbbell exercise device 600 according to another exemplary embodiment of the present invention. In the embodiment of FIG. 9, multiple resistance bands 606 are provided extending from one housing to 608 to a second housing 608. For example, three, four, or more resistance bands 606 may be provided.

Figure 10:
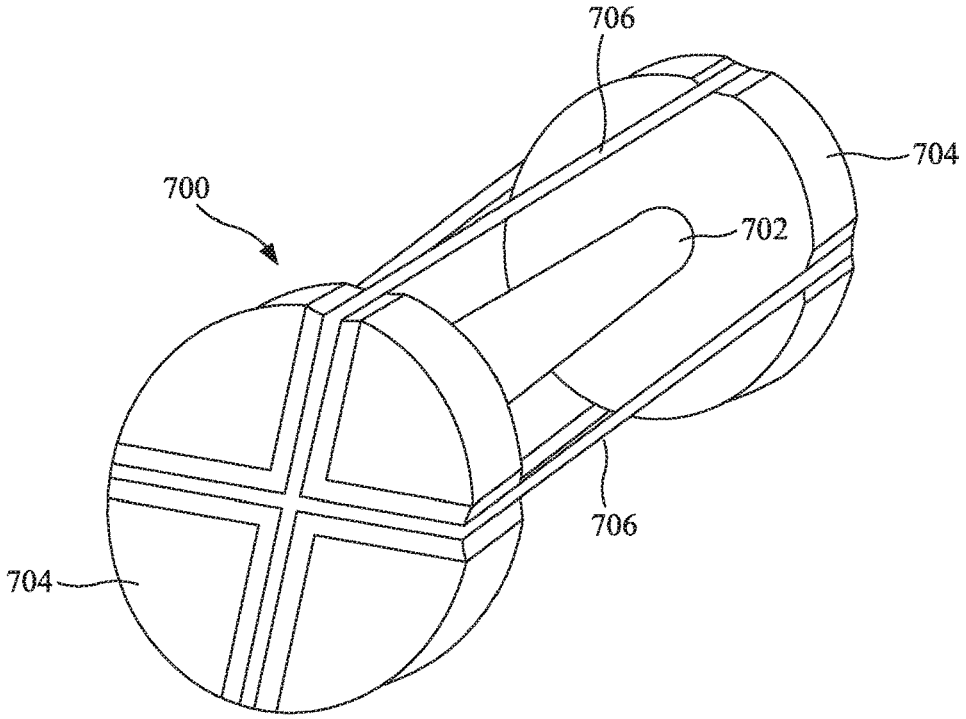
FIG. 10 is a perspective view of a dumbbell exercise device according to another exemplary embodiment of the present invention.

FIG. 10 is a perspective view of a dumbbell exercise device 700 according to another exemplary embodiment of the present invention. The end-weights 704 may include one or more grooves or slots at the perimeter of the end-weight 704. Each groove may help position a band on dumbbell exercise device 700. Additionally or alternatively, a cap may be provided to further secure each band in a corresponding groove or slot. Additionally, the cap may include structures corresponding to the end-weight grooves or slots.

Figure 11:
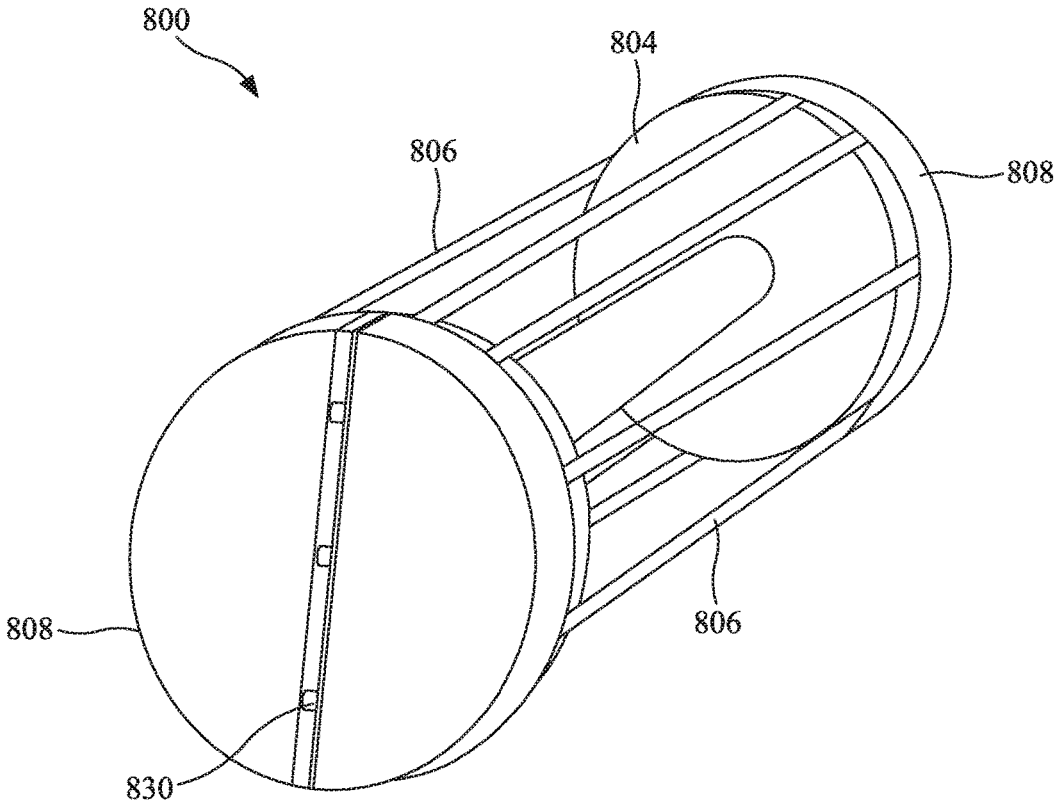
FIG. 11 is a perspective view of a dumbbell exercise device according to another exemplary embodiment of the present invention.

FIG. 11 is a perspective view of a dumbbell exercise device 800 according to another exemplary embodiment of the present invention. In the embodiment of FIG. 11, the housings 808 are formed of multiple pieces to facilitate easy manufacture and/or assembly of the housings 808 onto the end-weights 404. One or more resistance bands 806 may be fixedly attached to the one or more of the pieces of the housings 808. The multiple pieces of a housing may be placed around an end-weight 804 and secured to each other using poles 830. In an alternative embodiment, the multiple pieces of the housing may be joined along the sidewall of the housing instead of along a joint on the outer wall as shown in FIG. 11. Additionally or alternatively, the multiple pieces may snap, click, screw or otherwise fasten together.

Figure 12:
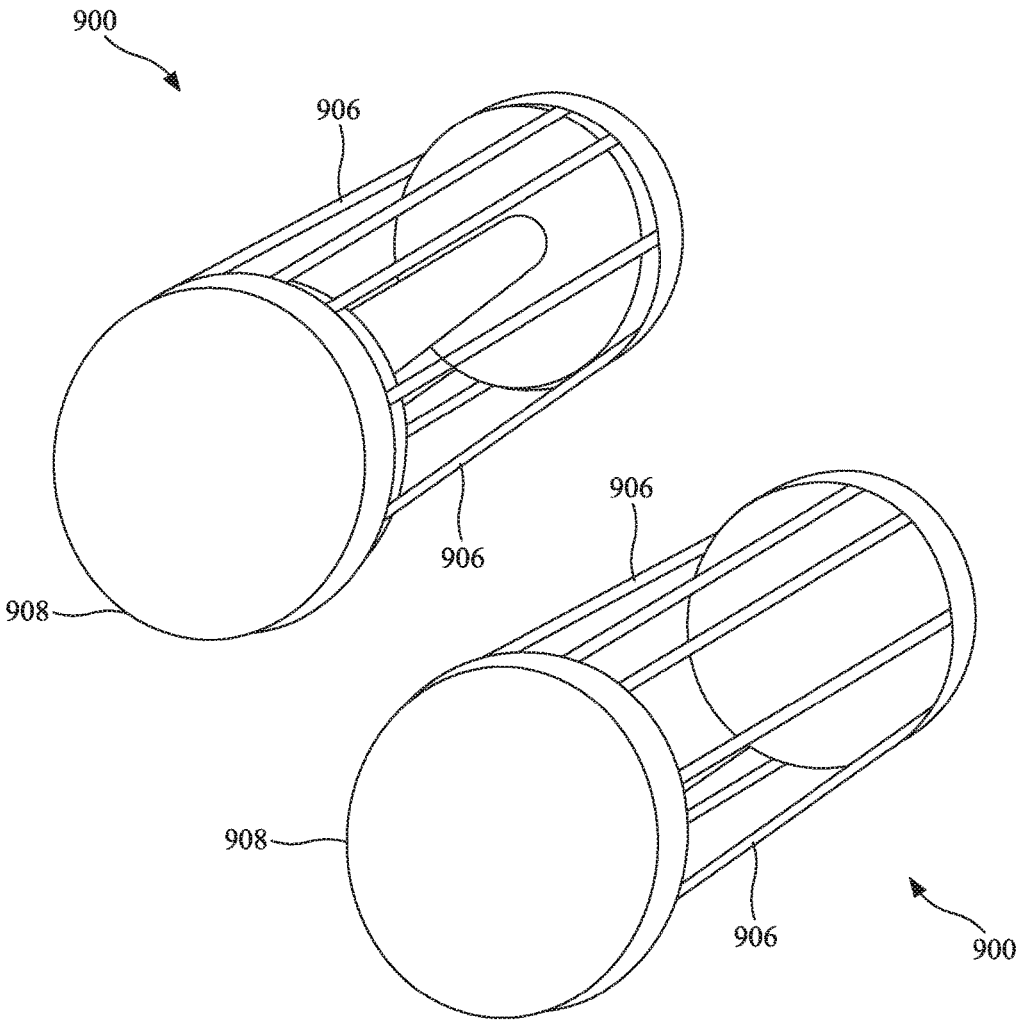
FIG. 12 contains two perspective views of a dumbbell exercise device according to another exemplary embodiment of the present invention.

FIG. 12 contains two perspective views of a dumbbell exercise device 900 according to another exemplary embodiment of the present invention. According to the embodiment of FIG. 12, the dumbbell exercise device 900 is configured for use with an existing dumbbell. The dumbbell exercise device 900 may include housings configured to receive end-weights of the existing dumbbell, and one or more resistance bands 906. The first view of the dumbbell exercise device 900 shows a dumbbell inserted into the device 900. The second view of the dumbbell exercise device 900 is shown without a dumbbell.

Figure 13:
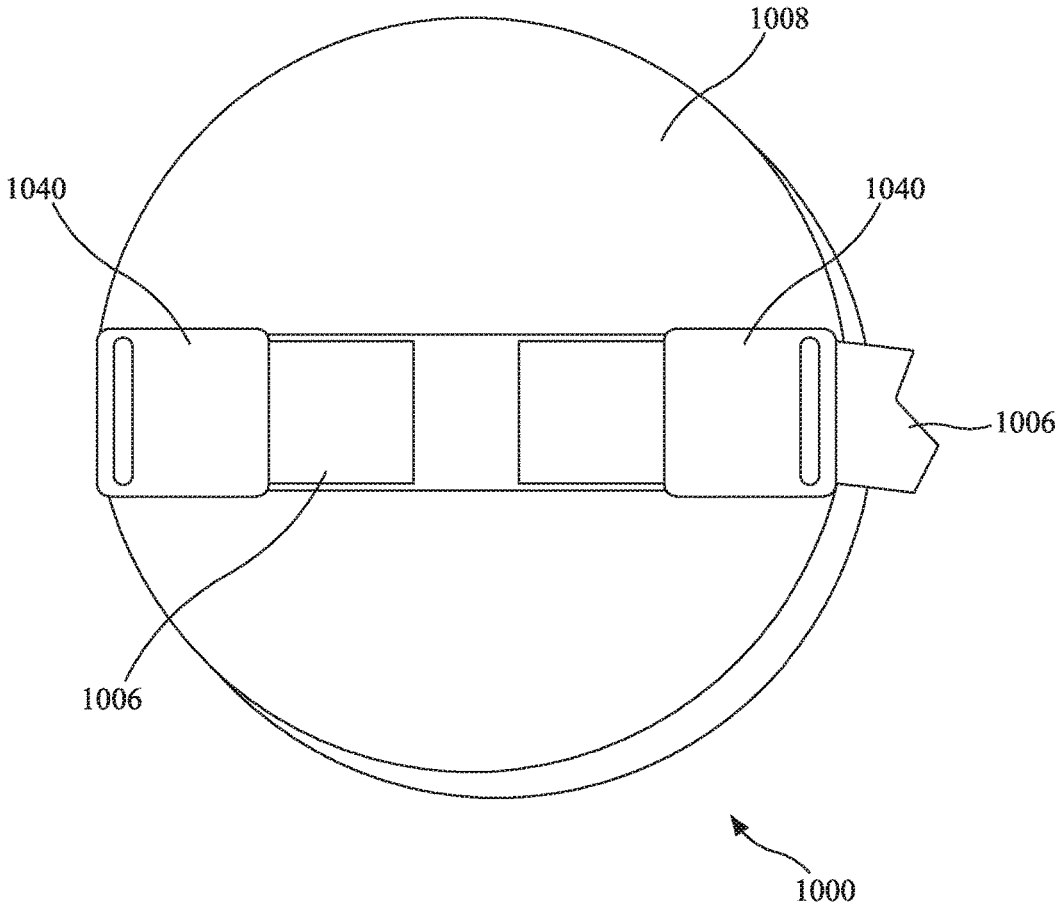
FIG. 13 is a side view of a dumbbell exercise device according to another exemplary embodiment of the present invention.
Figure 14:
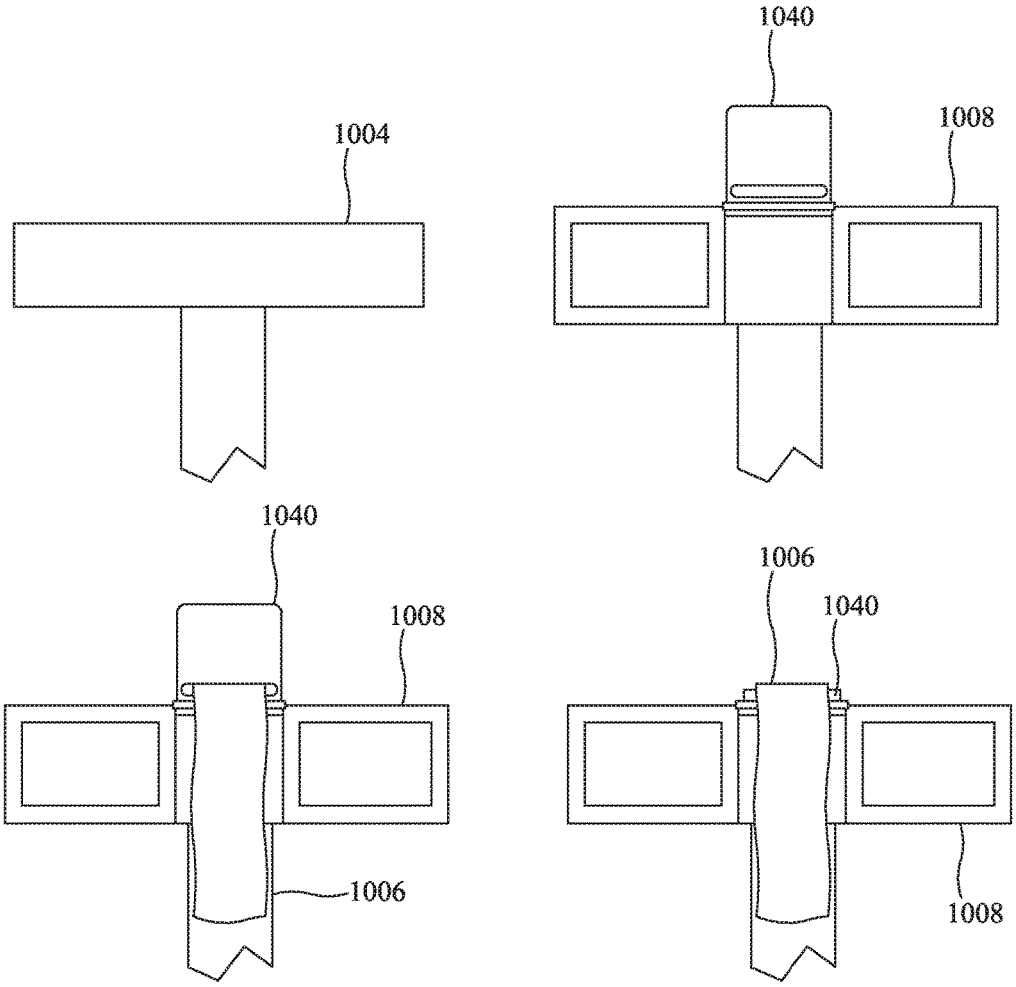
FIG. 14 contains four partial views of the dumbbell exercise device of FIG. 13.

FIG. 13 is a side view of a dumbbell exercise device 1000 according to another exemplary embodiment of the present invention. FIG. 14 contains four partial views of the dumbbell exercise device 1000 of FIG. 13. The dumbbell exercise device 1000 may include one or more housings 1008 fixedly attached to end-weights 1004. The housing 1008 may include one or more snaps 1040 configured to receive a resistance band 1006 through a slot and which may be fastened against the outer wall of the housing 1008. The snap may be used to adjust the tension of the resistance band 1006.

Embodiments of the present invention provide improved dumbbell exercise devices. Embodiments of the present invention may provide for a number of benefits. For example, a user can obtain an enhanced lifting effect with muscles traditionally exercised by conventional dumbbells. The gripping action may further engage muscle groups and simultaneously improve grip strength. As another exemplary benefit, the present embodiments provide a device well suited for manufacture, use and storage.

The foregoing description discloses only exemplary embodiments of the invention. Modifications of the above-disclosed embodiments of the present invention (beyond those modifications already mentioned) that fall within the scope of the invention will be readily apparent to those of ordinary skill in the art. For example, a weight having only a bar with no end-weights or where the end-weights are similar in perimeter to the perimeter of the bar could be provided with arched resistance bands. These and numerous other modifications fall within the scope of the invention.

Accordingly, although embodiments of the present invention have been shown and described, it would be appreciated by those skilled in the art that changes may be made in these embodiments without departing from the principles and spirit of the invention.

The invention claimed is:

1. A dumbbell exercise device, comprising:

a bar;

first and second end-weights at opposite ends of the bar, wherein the first and second end-weights each are of a shape including at least one flat side surface that extends along a longitudinal plane parallel or substantially parallel to the bar;

first and second housings receiving the first and second end-weights, respectively, wherein the first and second housings each include at least one flat inner surface of a sidewall engaging said at least one flat side surface along the longitudinal plane parallel or substantially parallel to the bar; and a resistance band extending within the first and second housings laterally along the sidewalls and tautly extending parallel or substantially parallel to the bar between the first and second end-weights at or near a perimeter of the first and second end-weights.

2. The dumbbell exercise device of claim 1, further comprising:

a second resistance band engaged by the first and second housings and extending between the first and second end-weights at or near the perimeter of the first and second end-weights opposite said resistance band.

3. The dumbbell exercise device of claim 1, further comprising:

a second resistance band engaged by the first and second housings and extending between the first and second end-weights at or near the perimeter of the first and second end-weights; and a third resistance band engaged by the first and second housings and extending between the first and second end-weights at or near the perimeter of the first and second end-weights.

4. The dumbbell exercise device of claim 1, wherein the resistance band extends between the first and second end-weights at two positions opposite one another.

5. The dumbbell exercise device of claim 1, wherein the resistance band extends between the first and second end-weights beyond the perimeter of the first and second end-weights.

6. The dumbbell exercise device of claim 1, wherein the resistance band is formed of rubber.

7. The dumbbell exercise device of claim 1, wherein two ends of the resistance band are connected to one of the first and second end-weights.

8. The dumbbell exercise device of claim 1, wherein the resistance band is engaged by a tensioner.

9. The dumbbell exercise device of claim 1, wherein the resistance band is a continuous band having no ends.

10. The dumbbell exercise device of claim 1, wherein the shape of the first and second end-weights is hexagonal, wherein said first and second housings include hexagon-shaped cavities to receive said first and second end-weights, respectively.

11. A dumbbell exercise device, comprising:

a bar;

first and second hexagonal end-weights fixedly attached to or integral with opposite ends of the bar;

a single rubber resistance band extending parallel or substantially parallel to the bar between the first and second hexagonal end-weights at or near a perimeter of the first and second hexagonal end-weights at two positions opposite to one another; and first and second hexagonal housings enclosing the first and second hexagonal end-weights, respectively, wherein the single rubber resistance band is engaged by the first and second housings thereby extending between the first and second hexagonal end-weights.

12. The dumbbell exercise device of claim 11, wherein two ends of the single rubber resistance band are connected to one of the first and second hexagonal end-weights.

13. The dumbbell exercise device of claim 11 wherein the single resistance band is a continuous band having no ends.

14. A dumbbell exercise device for use with a dumbbell, comprising:

a first end-weight housing configured to receive and at least partially enclose a first end-weight of the dumbbell;

a second end-weight housing configured to receive and at least partially enclose a second end-weight of the dumbbell, wherein the first and second end-weight housings each include a sidewall engaging respective first and second end-weights along a longitudinal plane parallel or substantially parallel to a bar of the dumbbell; and a resistance band extending within the first and second housings laterally along the sidewalls and tautly extending parallel or substantially parallel to the bar between the first and second end-weights at or near a perimeter of the first and second end-weights housings, wherein the first and second end-weight housings each include therein a cavity in the shape of a hexagon, a square, or a partial circle.

15. The dumbbell exercise device of claim 14, wherein the cavities of the first and second end-weight housings each include at least one flat inner surface of the sidewall configured to engage a flat surface of each of the first and second end-weights.

16. The dumbbell exercise device of claim 15, wherein the cavities of the first and second end-weight housings are hexagon-shaped cavities.

* * * * *